US007767922B2

(12) United States Patent
Cheng et al.

(10) Patent No.: US 7,767,922 B2
(45) Date of Patent: Aug. 3, 2010

(54) KEY MODULE

(75) Inventors: Yung-Fa Cheng, Taipei Hsien (TW); Kuo-Hsiang Wu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/202,408

(22) Filed: Sep. 1, 2008

(65) Prior Publication Data

US 2009/0288936 A1 Nov. 26, 2009

(30) Foreign Application Priority Data

May 21, 2008 (CN) ..... 200810301703

(51) Int. Cl.
*H01H 9/00* (2006.01)

(52) U.S. Cl. ..... 200/314

(58) Field of Classification Search ..... 200/314
See application file for complete search history.

(56) References Cited

U.S. PATENT DOCUMENTS

| | | | | |
|---|---|---|---|---|
| 6,284,988 | B1 * | 9/2001 | Watanabe et al. | 200/5 A |
| 6,993,830 | B2 * | 2/2006 | Shimizu et al. | 29/622 |
| 2007/0235306 | A1 * | 10/2007 | Chiba et al. | 200/314 |
| 2007/0235307 | A1 | 10/2007 | Liao et al. | |
| 2007/0268681 | A1 | 11/2007 | Tsai et al. | |

* cited by examiner

*Primary Examiner*—Michael A Friedhofer
*Assistant Examiner*—Lheiren Mae A Caroc
(74) *Attorney, Agent, or Firm*—Frank R. Niranjan

(57) ABSTRACT

An exemplary key module includes a elastic assembly, a light guide plate, and a key cap. The elastic assembly is including a flat plate and a resilient member. The light guide plate is defining at least one through hole for the resilient member to extend through. The light guide plate is disposed above and in parallel to the flat plate. The key cap is resiliently supported by the resilient member. The light guide plate transmits light through at least a portion of the key cap.

10 Claims, 2 Drawing Sheets

KEY MODULE

BACKGROUND

1. Field of the Invention

The present invention generally relates to key modules, and particularly to a key module with reduced height.

2. Description of Related Art

Generally, key modules utilized in portable electronic devices, such as notebook computers and mobile phones, are provided with light emitting elements and optical elements. The key modules are capable of emitting visible light generated from light emitting elements and traveling by optical elements, so the key can be seen in a dark environment.

However, adding an optical element to the key module may potentially increase a total height of the key module.

Therefore, providing a key module with added optical elements and a reduced height is desired.

SUMMARY

Accordingly, a key module with an optical element and a reduced height is provided. The key module includes an elastic assembly, a light guide plate, and a key cap. The elastic assembly includes a flat plate and a resilient member. The light guide plate defines at least one through hole for the resilient member to extend through. The light guide plate is disposed above and parallel to the flat plate. The key cap is resiliently supported by the resilient member. The light guide plate transmits light through at least a portion of the key cap.

Other advantages and novel features will become more apparent from the following detailed description of exemplary embodiment when taken in conjunction with the accompanying drawings.

DETAILED DESCRIPTION

Figure 1:
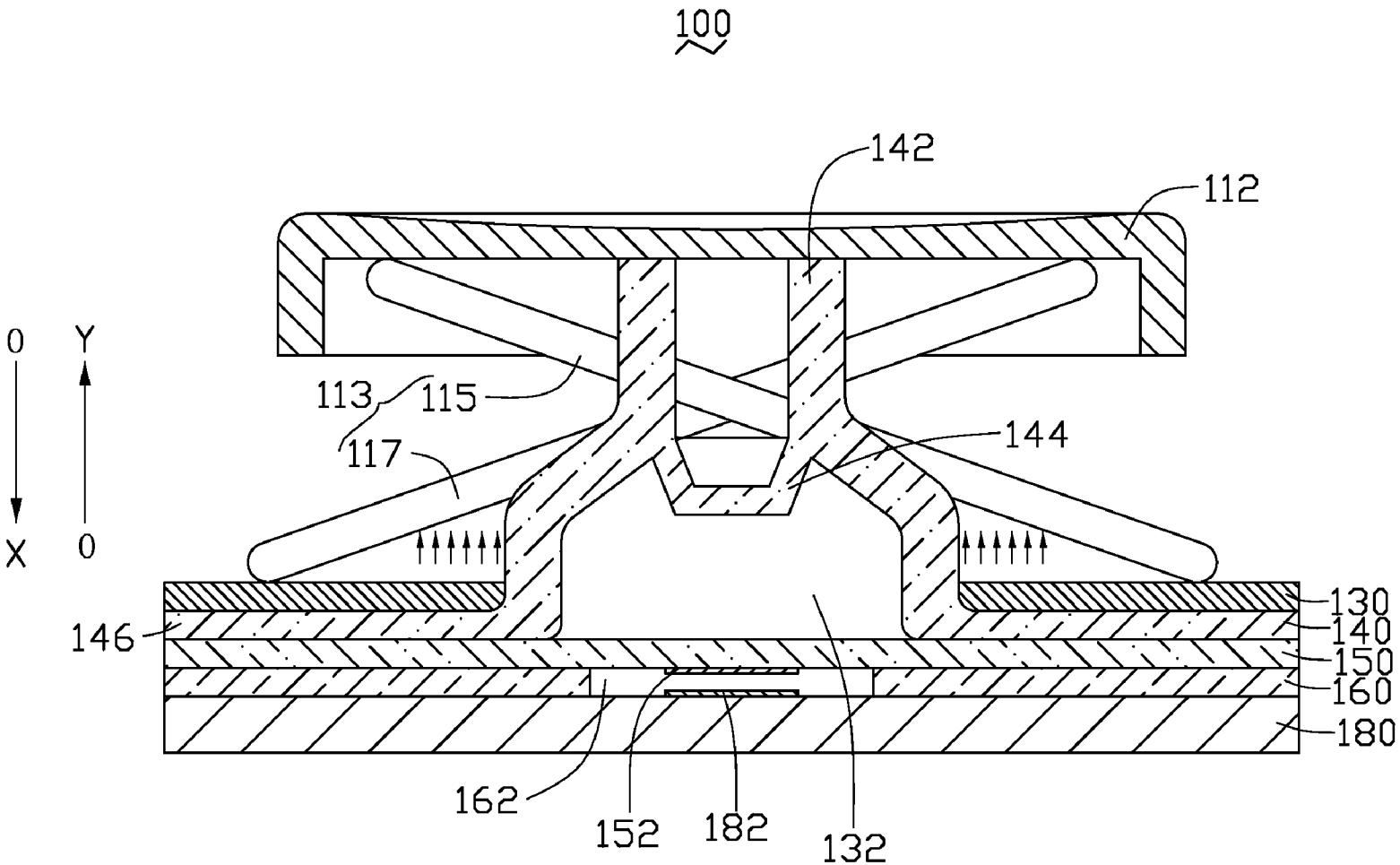
FIG. 1 is a cross-sectional view of a key module according to an exemplary embodiment.

Referring to FIG. 1, a key module 100 according to a first exemplary embodiment is illustrated. The key module 100 may be used as an input device in an electronic device (not shown), such as a portable computer, a mobile phone, and a personal digital assistant (PDA). The key module 100 is operable for inputting commands and/or information to the electronic device.

The key module 100 includes a key cap 112, a scissor-type connection mechanism 113, a light guide plate (LGP) 130, an elastic assembly 140, a membrane circuit board 150, a spacer sheet 160, and a printed circuit board (PCB) 180 for mounting the above-mentioned components thereon.

The key cap 112 is resiliently supported on the PCB 180 by the elastic assembly 140. The key cap 112 may be made of transparent or semi-transparent materials for passing and/or partially passing light. The key cap 112 may also be made of non-transparent materials, but configured with transparent characters for allowing light to transmit through the transparent characters.

The scissor-type connection mechanism 113 includes a first support leg 115 and a second support leg 117 intersected with each other. Each support leg 115, 117 has a first end pivotably connected to the LGP 130, and a second end slidably connected to the key cap 112.

The PCB 180 has one surface including at least a first conductive portion 182. The first conductive portion 182 may be formed as a contact or a trace.

The membrane circuit board 150 is made of elastic material, such as mylar. The membrane circuit board 150 deforms when an external force is applied to it. The membrane circuit board 150 has one surface including at least a second conductive portion 152 aligned with (facing to) the first conductive portion 182. The second conductive portion 152 may also be formed as a contact or a trace.

The spacer sheet 160 is disposed between the PCB 180 and the membrane circuit board 150. The spacer sheet 160 defines at least a first through hole 162 for allowing the first conductive portion 182 to contact the second conductive portion 152. When the key module 100 is in a free (normal) state, the second conductive portion 152 and the first conductive portion 182 are separated by the thickness of the spacer sheet 160, thus, forming an open circuit.

The elastic assembly 140 is disposed on a surface of the membrane circuit board 150 opposite to the surface having the second conductive portion 152. The elastic assembly 140 includes a first part formed as a substantially flat plate 146, and a second part (not labeled) protruding from the substantially flat plate 146. The second part integrally includes a resilient member 142 and an actuating member 144.

The resilient member 142 is made of non-transparent material, and has an end thereof connected to the key cap 112. When the key cap 112 is pressed by an external force, the resilient member 142 deforms, and moves along a first direction (see O-X of FIG. 1) substantially perpendicularly to and towards the PCB 180. After the external force is released, the resilient member 142 can provide a restoring force for pushing the key cap 112 along a second direction (see O-Y of FIG. 1) opposite to the first direction, to return the key cap 112 to the normal state.

When the resilient member 142 deforms, the actuating member 144 can press the membrane circuit board 150, through the first through hole 162, so the second conductive portion 152 can contact the first conductive portion 182, thus, forming a closed circuit.

The LGP 130 is disposed above and parallel to the flat plate 146. The LGP 130 is configured for transmitting light emitted from a light source, such as a light emitting diode (LED) (not shown), to the key cap 112. The LGP 130 defines at least a second through hole 132. The second through hole 132 is arranged for allowing the resilient member 142 to be displaced (move) towards the membrane circuit board 150 along the first direction.

When assembling, first, the key module 100 is assembled by sequentially mounting the spacer sheet 160, the membrane circuit board 150, the elastic assembly 140, and the LGP 130 on the PCB 180. The LGP 130 is disposed substantially parallel to, and above, the flat plate 146. The resilient member 142 extends through the second through hole 132 defined by the LGP 130. Second, the resilient member 142 is connected to the key cap 112, and the scissor-type connection mechanism 113 is coupled between the key cap 112 and the LGP 130.

When the key module 100 is actuated, the LGP 130 transmits light from a light source substantially along the second direction (see O-Y of FIG. 1) through the key cap 112. As such, the key module 100 can be more easily seen in dark environments. When the key cap 112 is pressed, the resilient member 142 becomes deformed, and displaces the actuating member 144 toward the resilient member 142, thus, pressing the membrane circuit board 150. As a result, the membrane circuit board 150 becomes deformed, causing the second conductive portion 152 to electrically contact the first conductive portion 182, thereby forming a closed circuit and generating a signal indicating that the key module 100 is being pressed.

Figure 2:
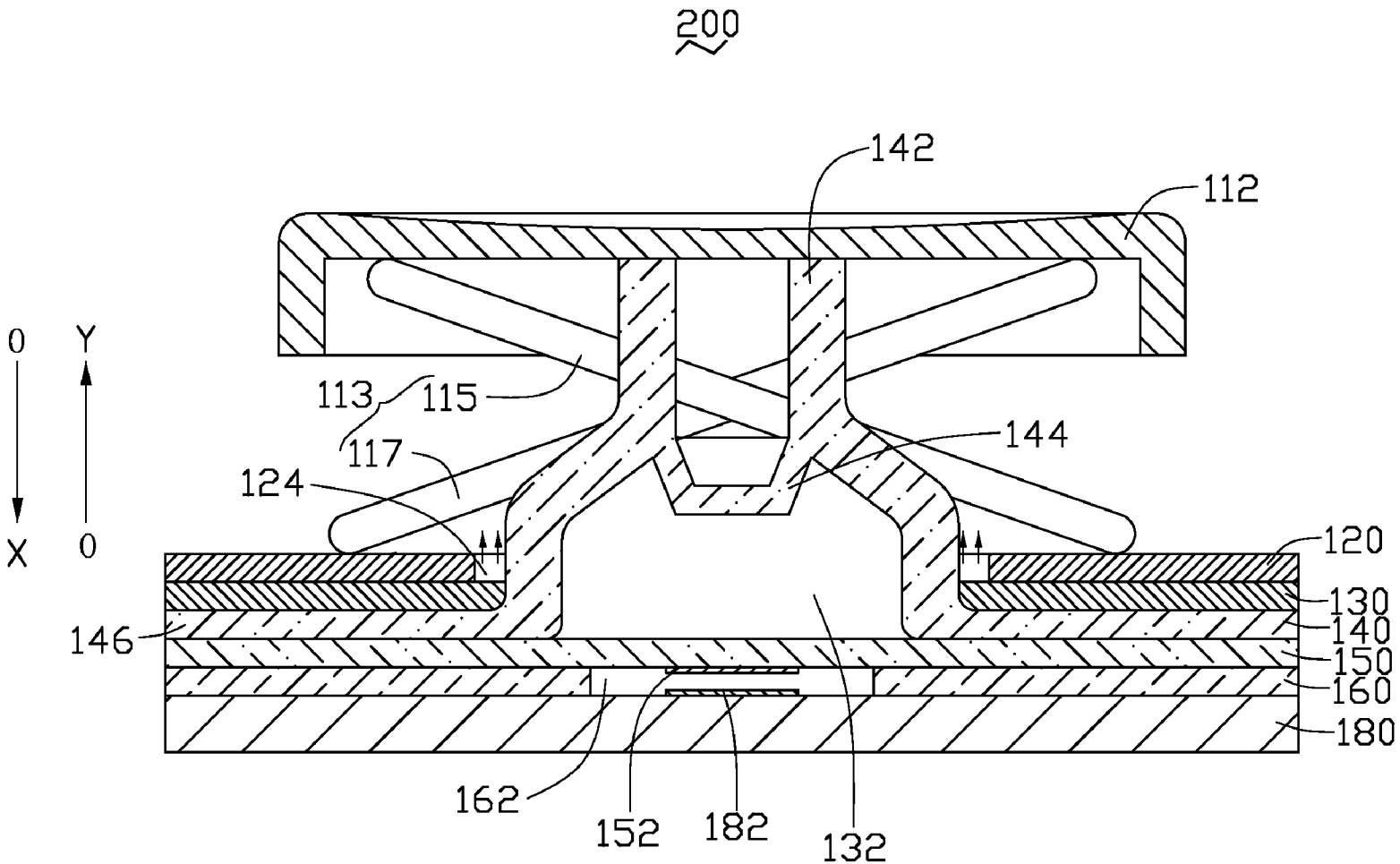
FIG. 2 is a cross-sectional view of a key module according to a second exemplary embodiment.

Referring to FIG. 2, a second exemplary embodiment of a key module 200 is illustrated. The key module 200 has similar constructions with the key module 100 illustrated in FIG. 1. The key module 200 of the second exemplary embodiment further includes a reinforcing plate 120 disposed above and parallel to the LGP 130. In this embodiment, the scissor-type connection mechanism 113 is coupled between the key cap 112 and the reinforcing plate 120.

The reinforcing plate 120 may be made of a metal for reinforcing the elastic assembly 140 and the membrane circuit board 150. The reinforcing plate 120 defines at least a third through hole 124. The diameter of the third through hole 124 is slightly larger than the diameter of the second through hole 132, such that a portion of the light transmitted from the LGP 130 can pass through the third through hole 124 and then to the key cap 112.

As described above, the LGP 130 defines the second through hole 132 for the resilient member 142 to extend through, a whole height of the key module 100 is determined by heights of the key cap 112, the elastic assembly 140, the membrane circuit board 150, the spacer sheet 160, and the printed circuit board 180. Thus, adding the LGP 130 to the key module 100 does not increase the height of the key module 100.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A key module, comprising:

an elastic assembly including a flat plate and a resilient member;

a light guide plate defining at least one first through hole for the resilient member to extend through, the light guide plate being disposed above and parallel to the flat plate;

a key cap resiliently supported by the resilient member, the light guide plate transmitting light through at least a portion of the key cap; and a reinforcing plate disposed above the light guide plate, the reinforcing plate defining at least one second through hole corresponding to the at least one first through hole for the resilient member to extend therethrough, the reinforcing plate further defining a gap substantially surrounding the resilient member for allowing a portion of the light from the light guide plate to be transmitted through the gap to the key cap.

2. The key module of claim 1, further comprising:

a printed circuit board including at least one first conductive portion on one surface of the printed circuit board.

3. The key module of claim 2, further comprising:

a membrane circuit board including at least one second conductive portion on a surface thereof and corresponding to the at least one first conductive portion, the membrane circuit board being resiliently deformed for electrically connecting the at least one second conductive portion of the membrane circuit board with the at least one first conductive portion of the printed circuit board.

4. The key module of claim 3, wherein the elastic assembly is disposed above the membrane circuit board.

5. The key module of claim 3, further comprising:

a spacer sheet disposed between the printed circuit board and the membrane circuit board, the spacer sheet defines at least one through hole, allowing the at least one second conductive portion to protrude therethrough for contacting with the at least one first conductive portion.

6. The key module of claim 3, further comprising:

an actuating member, the actuating member capable of being moved together with the resilient member upon an external force exerted thereto for touching the membrane circuit board, causing the at least one second conductive portion to electrically contact the at least one first conductive portion.

7. The key module of claim 6, wherein the actuating member integrally includes the resilient member.

8. The key module of claim 1, wherein the reinforcing plate is made of a metal.

9. A key module, comprising:

an elastic assembly including a flat plate and a resilient member;

a light guide plate defining at least one first through hole for the resilient member to extend through, the light guide plate being disposed above and parallel to the flat plate;

a key cap resiliently supported by the resilient member; and a reinforcing plate disposed above the light guide plate, the reinforcing plate defining at least one second through hole corresponding to the at least one first through hole, the resilient member extending through the at least one second through hole, the at least one second through hole of the reinforcing plate having a diameter substantially larger than that of the at least one first through hole of the light guide plate, such that the light guided by the light guide plate is capable of being transmitted through the at least one second through hole to the key cap.

10. The key module of claim 9, further comprising:

a scissor-type connection mechanism coupling the key cap to the reinforcing plate.

* * * * *